US011424526B2

(12) United States Patent
Ma et al.

(10) Patent No.: US 11,424,526 B2
(45) Date of Patent: Aug. 23, 2022

(54) ANTENNAS AND CONNECTORS LOCATED IN SLOTS

(71) Applicant: HEWLETT-PACKARD DEVELOPMENT COMPANY, L.P., Spring, TX (US)

(72) Inventors: Chin-Hung Ma, Taipei (TW); Chien-Pai Lai, Taipei (TW); Ju-Hung Chen, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 7 days.

(21) Appl. No.: 16/761,006

(22) PCT Filed: Dec. 15, 2017

(86) PCT No.: PCT/US2017/066630

§ 371 (c)(1),
(2) Date: May 1, 2020

(87) PCT Pub. No.: WO2019/117941

PCT Pub. Date: Jun. 20, 2019

(65) Prior Publication Data

US 2021/0036402 A1 Feb. 4, 2021

(51) Int. Cl.

| | |
|---|---|
| ***H01Q 1/36*** | (2006.01) |
| ***H01Q 1/22*** | (2006.01) |
| ***H01Q 13/10*** | (2006.01) |

(52) U.S. Cl.

CPC ..... *H01Q 1/2266* (2013.01); *H01Q 1/36* (2013.01); *H01Q 13/10* (2013.01); *H01Q 1/2291* (2013.01)

(58) Field of Classification Search

CPC ..... H01Q 1/2266; H01Q 1/2291; H01Q 13/10
See application file for complete search history.

(56) References Cited

U.S. PATENT DOCUMENTS

| | | | | |
|---|---|---|---|---|
| 6,531,985 | B1 | 3/2003 | Jones | |
| 6,686,886 | B2 | 2/2004 | Flint | |
| 8,223,082 | B2 | 7/2012 | Chiang et al. | |
| 9,496,599 | B1 | 11/2016 | Huang et al. | |
| 2004/0160370 | A1* | 8/2004 | Ghosh | G06F 1/1616 343/702 |
| 2005/0146475 | A1 | 7/2005 | Bettner et al. | |

(Continued)

FOREIGN PATENT DOCUMENTS

| | | | |
|---|---|---|---|
| CN | 102576963 | A | 7/2012 |
| CN | 102709684 | A | 10/2012 |

(Continued)

OTHER PUBLICATIONS

Pi Zero W // αXa6p» URL: https://habr.com/post/401925/ Feb. 28, 2017, 1-3, 5-8, 11-12, 4, 9-10, 13-15.

(Continued)

*Primary Examiner* — Graham P Smith
(74) *Attorney, Agent, or Firm* — HPI Patent Department

(57) ABSTRACT

An example device includes a conductive housing. The conductive housing has a slot containing a dielectric material. An antenna includes a resonating element disposed within the slot. A first connector is disposed within the slot. A second connector is disposed within the slot. The resonating element of the antenna is located between the first connector and the second connector.

15 Claims, 6 Drawing Sheets

(56) References Cited

U.S. PATENT DOCUMENTS

| | | | | |
|---|---|---|---|---|
| 2011/0089792 | A1 | 4/2011 | Casebolt | |
| 2013/0009833 | A1 | 1/2013 | Kough et al. | |
| 2014/0184450 | A1 | 7/2014 | Koo et al. | |
| 2016/0351995 | A1* | 12/2016 | Huang | H01Q 1/243 |
| 2017/0117609 | A1 | 4/2017 | Chen | |
| 2017/0250475 | A1* | 8/2017 | Liu | H01Q 21/30 |
| 2019/0036223 | A1* | 1/2019 | Wu | H01Q 13/106 |

FOREIGN PATENT DOCUMENTS

| | | | |
|---|---|---|---|
| CN | 104037492 | A | 9/2014 |
| CN | 106058429 | A | 10/2016 |
| EP | 1280045 | A1 | 1/2003 |

OTHER PUBLICATIONS

Pulse Granted Small Slot Antenna Solution for the Metal Device, Apr. 14, 2017, https://www.pulseelectronics.com/news/pulse-granted-small-slot-antenna-solution-for-the-metal-device/.

* cited by examiner

ANTENNAS AND CONNECTORS LOCATED IN SLOTS

BACKGROUND

Portable computers and communications devices have become increasingly popular. These devices are often provided with wireless communication capabilities. Antennas in the devices are an integral part used to facilitate communications with wireless networks. The amount of data that is communicated, and the distance and coverage of a wireless connection depend on the size, type and configuration of the antenna.

DETAILED DESCRIPTION

Portable computers and communications devices are often compact and may have limited space for an antenna. Antennas are typically located near the display element of the lid or in the hinge area. It can be difficult to locate antennas in metal surfaces, such as the base of the portable computer, because metal may interfere with, impede or shield, the antenna signal. When the antenna is mounted inside of metal surfaces, it may be difficult to transmit or receive signals, and the signal radiation may cause electronic interference to other elements.

A device, such as part of a computer device, has an antenna for wireless communications. The device has a conductive housing with a slot. The antenna includes a resonating element disposed in the slot. A first connector and a second connector, such as a data bus connector, an audio connector, a video connector, a media connector, a data connector, a networking connector or a power jack connector, are also disposed in the slot and the resonating element is between the first connector and the second connector. By doing so, the existing form factor of the computer device is utilized, and the aesthetics of the device may not be compromised by adding additional holes or slots. The antenna may be located where it otherwise couldn't have been, which may effectively utilize available space in a crowded environment. Moreover, an additional antenna may be available for use. Increased bandwidth or range for wireless communications may be realized.

Figure 1:
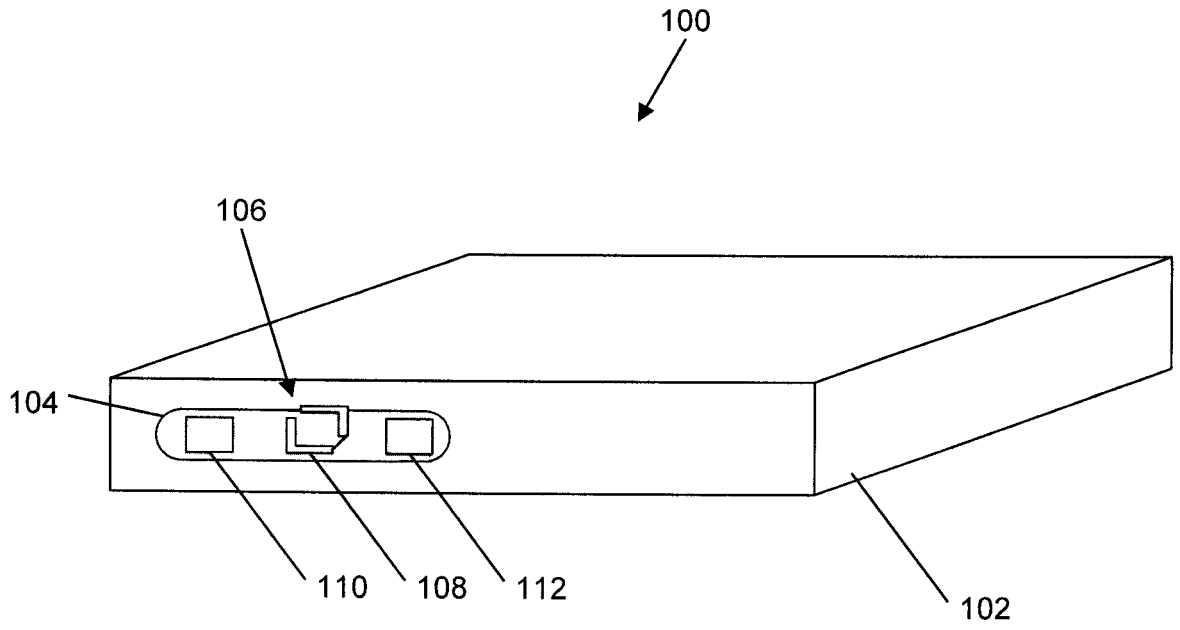
FIG. 1 is a simplified schematic of an example device with an antenna.

FIG. 1 is a simplified schematic of an example device 100 with an antenna 106. The device 100 may be part of an electronic device or a computer device, such as a notebook computer, a laptop computer, or a desktop computer. The device 100 includes a conductive housing 102. A portion of, or the entire conductive housing 102 may be comprised of a metal material such as aluminum, steel, magnesium, titanium, or combinations thereof. The metal material may enable a lightweight design for easy and convenient portability while having increased durability over non-metal materials by providing scratch-resistant surfaces. The conductive housing 102 has a slot 104 which may be a single slot of a plurality of slots. The slot 104 provides a resonating area for the antenna 106. The antenna 106 may freely transmit and receive radio-frequency signals that are not blocked by conductive housing 102 and may be a single band or dual band antenna. Device 100 may merge structures from antenna 106 with other types of antennas to form hybrid antennas.

The slot 104 may contain a nonconductive, insulation or dielectric material such as a composite, glass, porcelain, ceramic, epoxy or air. The dielectric material may be deposited a surface of the slot 104. It may reduce exposure of the antenna 106 to electromagnetic interference generated by the other circuits or antennas in the device 100.

The antenna 106 within the conductive housing 102 includes a resonating element 108 disposed within the slot 104. A first connector 110 is disposed within the slot 104. A second connector 112 is disposed within the slot 104. The first connector 110 and the second connector 112 may be any type of connector. For example, the first connector 110 and the second connector 112 may be a data bus connector such as a Universal Serial Bus (USB) connector; an audio connector such as a headphone connector or a digital optical audio connector; a video connector such as a VGA connector, a DVI monitor connector or a S-video connector; a media connecter such as a RCA connector, a High Definition Multimedia Interface (HDMI) connector, or a display port connector; a data connector such as a firewire (IEEE 1394) connector or an ESATA connector; a networking connector such as a phone connector or an ethernet connector; or a power jack connector. The resonating element 108 of the antenna 106 is located between the first connector 110 and the second connector 112.

The dielectric material may be applied to a surface or a plurality of the surfaces of the slot 104 such as by painting, spraying, bonding, baking, or the like. In some embodiments, the dielectric material may form a component integral with the first connector 110, the resonating element 108 and the second connector 112. In a non-limiting example, the dielectric material may be made from plastic in which a component may be formed from the plastic that is inserted or placed in the slot 104 during manufacturing. For ease and convenience during assembly, the first connector 110, the resonating element 108 and the second connector 112 may be coupled to the component thus eliminating steps from assembly.

Figure 2:
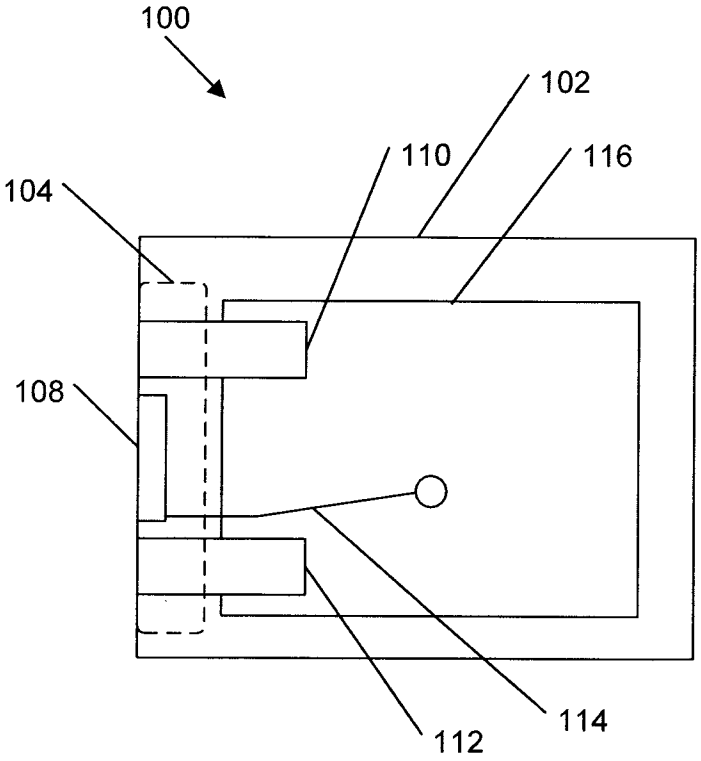
FIG. 2 depicts a top view a simplified schematic of the example device with an antenna.

FIG. 2 depicts a top view a simplified schematic of the example device 100 with an antenna 106. The slot 104 is shown in broken lines for convenience. The resonating element 108 is coupled to an integrated circuit such as a printed circuit board 116, via a cable 114. The cable 114 may be a coaxial cable. The printed circuit board 116 may be rigid or flexible and is coupled to the conductive housing 102. Other electronic components may be coupled to the conductive housing 102. The printed circuit board 116 includes wireless communication circuitry with radio-frequency (RF) circuitry for handling radio-frequency communications bands such as 2.4 GHz and 5 GHz bands for WiFi (IEEE 802.11) communications and the 2.4 GHz Bluetooth® communications band. For example, the cable 114 may be used to convey radio-frequency signals between the antenna 106 and the radio-frequency circuitry such as WiFi and Bluetooth circuitry. The first connector 110 and the second connector 112 are coupled to the printed circuit board 116.

Metal portions of the conductive housing 102 or metal components in the conductive housing 102 may provide the ground for the antenna 106. Examples may include the conductive housing 102, the printed circuit board 116, the first connector 110, the second connector 112, or a combination thereof. The cable 114 is coupled to the printed circuit board 116 and the resonating element 108 which is the excitation section. Therefore, the communication signal from the printed circuit board 116 is sent to the resonating element 108 via the cable 114 for distant transmission, and the distant communication signal is delivered to the printed circuit board 116 via the cable 114.

Figure 3:
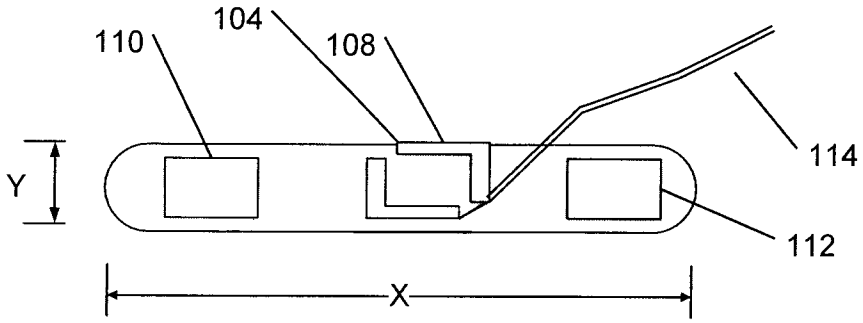
FIG. 3 is a view of a slot in the device with a first connector, a resonating element and a second connector.

FIG. 3 is a view of a slot 104 in the device 100 with a first connector 110, a resonating element 108 and a second connector 112. This may be a slot in the device 100 or the component formed from the dielectric material integral with the first connector 110, the resonating element 108 and the second connector 112. The first connector 110 and the second connector 112 are shown with the resonating element 108 located between the first connector 110 and the second connector 112. The slot 104, or a portion of the slot 104, may be open for access, or may be closed such as contained within the conductive housing 102, or having a cover coupled over the slot 104. This may enable the desired wavelength or frequency range for the antenna 106 while providing protection from damage or debris.

Adding the antenna 106 to the slot 104 may be relatively simple compared to adding other types of antennas. Moreover, adding the antenna 106 to the slot 104 may reduce the weight of the device 100 by removing a portion of the conductive housing 102 which may be cost effective and thus reduce manufacturing costs.

The slot 104 is sized so the antenna 106 operates in a desired communications band (e.g., 2.4, etc.). The slot is sized with a length X and a height Y. The length of the slot 104 conforms to an electromagnetic wavelength of the resonating element 108. For example, the length of the slot 104 may be equal to a quarter of a wavelength. Moreover, the length of the slot 104 is greater than the height of the slot 104. In a non-limiting example, the length of the slot 104 is approximately 40-50 mm and the height of the slot 104 is approximately 2-5 mm.

The resonating element 108 may be a single element or a plurality of elements of any size or shape to produce the desired wavelength based on the frequency of the application. The resonating element 108 may be made from a metal material such as aluminum, steel, magnesium, titanium, or combinations thereof. For example, the shape of the resonating element 108 may have right angles or curves and include shapes such as variations of rectangles, L-shapes, S-shapes, or the like. By using a plurality of resonating elements 108 of different sizes and/or shapes, the antenna 106 may be designed to cover a wider bandwidth.

Figure 4:
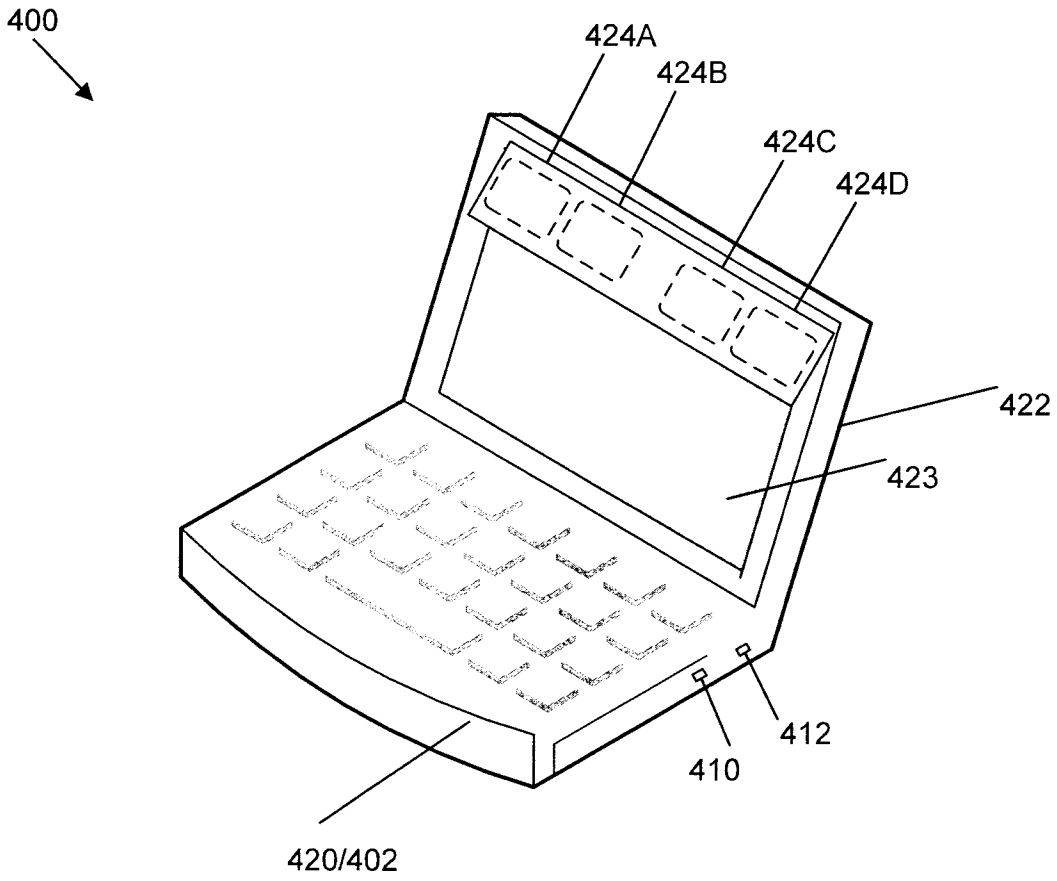
FIG. 4 shows a perspective view of a computer device with an arrangement of antennas in a lid of the computer device.

FIG. 4 shows a perspective view of a computer device 400 with an arrangement of antennas in a lid 422 of the computer device 400. The device 400 may be a computer device. The device 400 includes a base 420 including a processor, a conductive housing 402, a first connector 410 and a second connector 412. The lid 422 is coupled to the base 420 and has a display element 423. The computer device 400 may have dedicated antennas 424A-D for Wireless Wide Area Networks (WWAN) and Wireless Local Area Networks (WLAN). For example, WWAN main 424A, WLAN aux 424B, WLAN main 424C and WWAN aux 424D may be in the lid 422 portion of the computer device 400.

Figure 5:
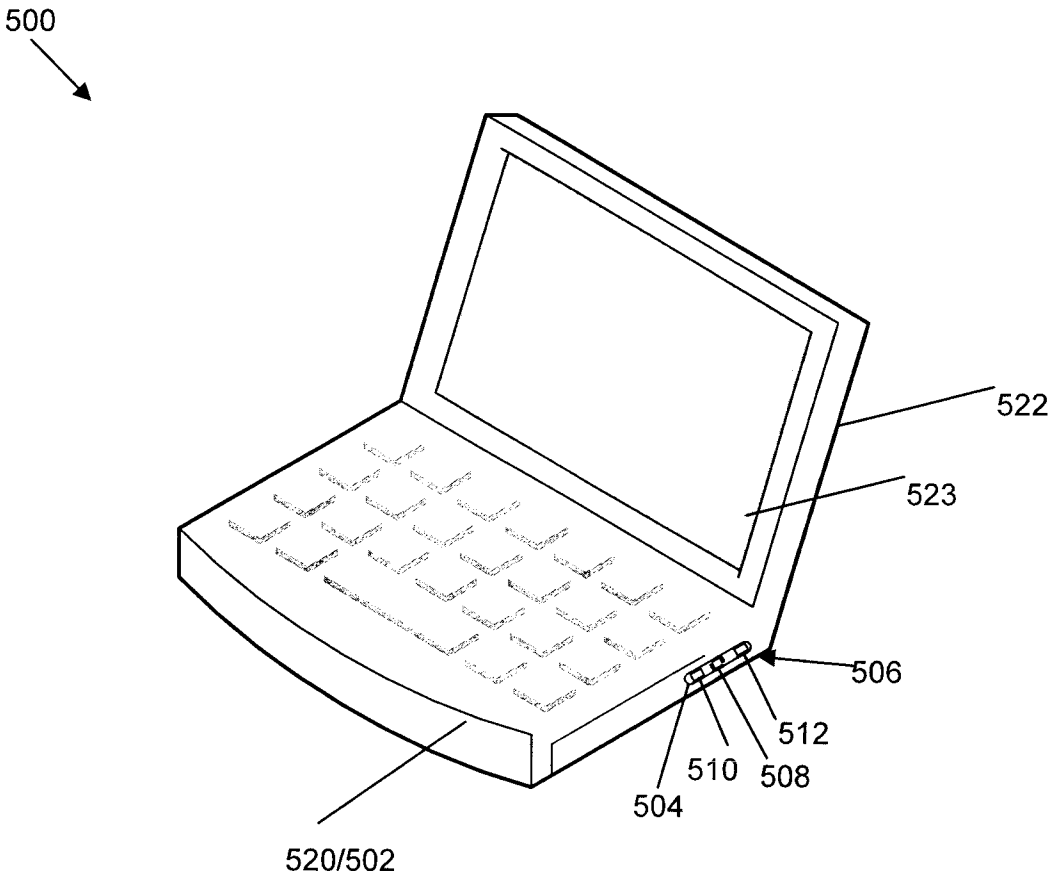
FIG. 5 shows a perspective view of a computer device with an example antenna design in a base of the computer device.

FIG. 5 shows a perspective view of a computer device 500 with an example antenna design in a base 520 of the computer device 500. Computer device 500 may have antennas located in a lid 522, as shown in computer device 400 of FIG. 4. An additional antenna 506 to the antennas in the lid 522 in the computer device 500 may be provided by forming a slot 504 in a conductive housing 502 of the base 520. The slot 504 includes a dielectric material. This may increase the throughput for wireless communication or provide an additional antenna 506.

The first connector 510 and the second connector 512 are disposed in the slot 504. The first connector 510 and the second connector 512 may be a data bus connector such as a Universal Serial Bus (USB) connector; an audio connector such as a headphone connector or a digital optical audio connector; a video connector such as a VGA connector, a DVI monitor connector or a S-video connector; media connecter such as a RCA connector, a High Definition Multimedia Interface (HDMI) connector, or a display port connector; a data connector such as a firewire (IEEE 1394) connector or an ESATA connector; a networking connector such as a phone connector or an ethernet connector; or a power jack connector.

An antenna 506 includes a resonating element. The resonating element 508 is between the first connector 510 and the second connector 512. The location of the slot 504 in the base 520 is shown in FIG. 5 as a non-liming example. The slot 504 may be located anywhere in the base 520 and depends on the existing form factor location of the of the first connector 510 and the second connector 512. There may be a plurality of antennas 506 located in the base 520.

Figure 6:
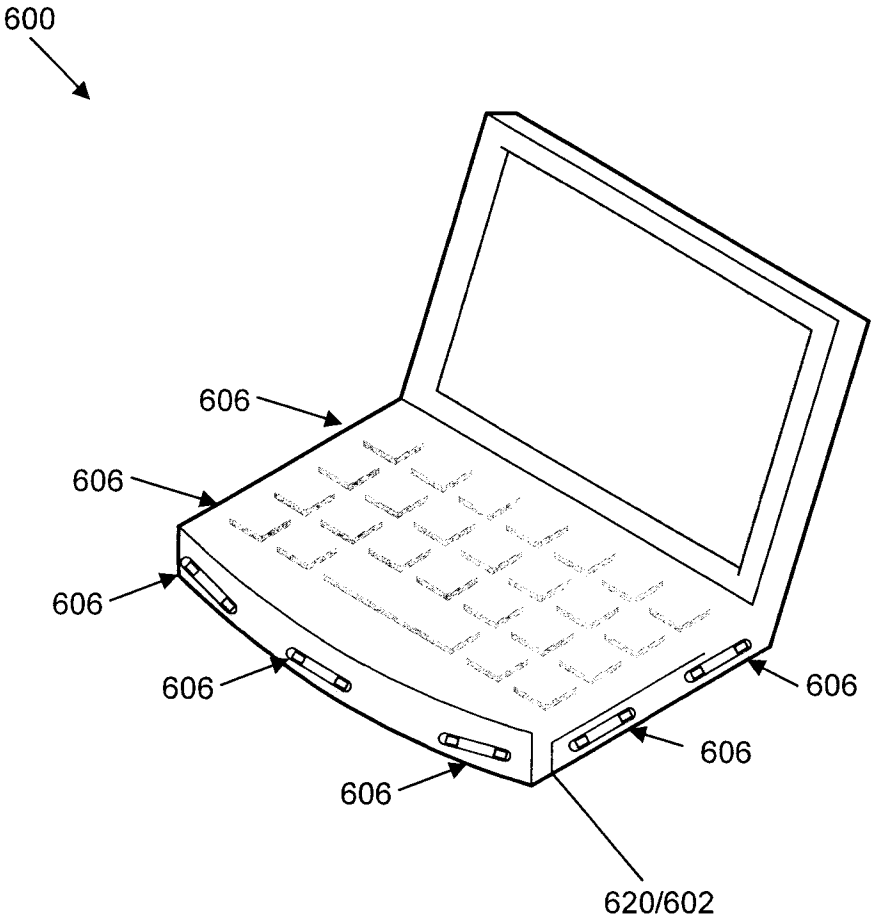
FIG. 6 is a perspective view of a computer device with multiple antennas in various locations in a base of the computer device.

FIG. 6 is a perspective view of a computer device 600 with multiple antennas 606 in various locations in a base 620 of the computer device 600. As described herein, device 100 may be implemented in the computer device 600. For example, computer device 600 may have any suitable number of antennas 606 located in a conductive housing 602 of the base 620. There may be, for example, one antenna 606, two antennas 606, three antennas 606, or more than three antennas 606. Each antenna 606 may be located in any location depending on the existing location of the first connector and the second connector, and may handle communications over a single communications band or multiple communications bands.

Referring to FIGS. 1-3, locating the slot 104 to include the first connector 110 and the second connector 112 of the device 100 uses the existing form factor of the device 100 and is virtually invisible to a user. With this low profile, the aesthetics of the device 100 are not affected or diminished.

Moreover, it allows the slot 104 to be located where otherwise it couldn't have been located. For example, the base of the computer device is crowded with other components not allowing vacant space for the antenna 106. The thickness of the base often has a tapered design whereby the first connector 110 and the second connector 112 are in the thickest area of the base. By including the first connector 110 and the second connector 112 as part of the slot 104, there is adequate thickness to accommodate the antenna when compared to the thinner areas of the base.

The slot 104 requires less space in the base when compared to other antenna designs because it incorporates the existing first connector 110 and the second connector 112. For example, when locating the antenna in the base, in an example embodiment, the slot distance may be 50 mm. Since the distance of the first connector 110 and the second connector 112 may be 10 mm respectively, only 30 mm of space is needed for the slot 106 as opposed to the 50 mm. The slot encompasses the first connector 110 and the second connector 112 to provide for transmission of the correct wavelength range of the antenna 106.

It is difficult to locate antennas in metal, conductive surfaces, because metal can interfere with, impede or shield, the antenna signal. As disclosed herein, device 100 may provide an additional antenna 406 while increasing the throughput and range for wireless communications.

It should be recognized that features and aspects of the various examples provided above can be combined into further examples that also fall within the scope of the present disclosure. In addition, the figures are not to scale and may have size and shape exaggerated for illustrative purposes.

The invention claimed is:

1. A device comprising:

a conductive housing;

a slot in the conductive housing, the slot containing a dielectric material;

an antenna including a resonating element disposed within the slot;

a first connector disposed within the slot; and a second connector disposed within the slot, wherein the resonating element of the antenna is located between the first connector and the second connector, wherein the slot comprises a backwall and sidewalls and an opening in the conductive housing having a same length and height as the backwall, a surrounding surface of the conductive housing defines edges of the opening, wherein the edges of the opening surround the antenna, the first connector and the second connector, and wherein the dielectric material both supports and surrounds the antenna, the first connector and the second connector, and the dielectric material is provided within the slot and is coplanar to the opening.

2. The device of claim 1, wherein the first connector and second connector are a data bus connector, an audio connector, a video connector, a media connector, a data connector, a networking connector or a power jack connector.

3. The device of claim 1, wherein the resonating element is coupled to a circuit of a printed circuit board via a cable, the printed circuit board is coupled to the conductive housing.

4. The device of claim 1, wherein the dielectric material forms a component integral with the first connector, the resonating element, and the second connector.

5. The device of claim 1, wherein the conductive housing is part of a computer device.

6. A device comprising:

a base including a processor, a conductive housing, a first connector and a second connector;

a lid coupled to the base;

a slot formed in the conductive housing, the slot including a dielectric material, wherein the first connector and the second connector are disposed in the slot; and an antenna including a resonating element, the resonating element located between the first connector and the second connector, wherein the slot comprises a backwall and sidewalls and an opening in the conductive housing having a same length and height as the backwall, a surrounding surface of the conductive housing defines edges of the opening.

wherein the edges of the opening surround the antenna, the first connector and the second connector, and wherein the dielectric material both supports and surrounds the antenna, the first connector and the second connector, and the dielectric material is provided within the slot and is coplanar to the slot.

7. The device of claim 6, wherein the device is a computer device.

8. The device of claim 6, wherein the first connector and second connector are a data bus connector, an audio connector, a video connector, a media connector, a data connector, a networking connector or a power jack connector.

9. The device of claim 6, wherein a length of the slot conforms to an electromagnetic wavelength of the resonating element.

10. The device of claim 6, wherein the dielectric material is deposited on a surface of the slot.

11. A device comprising:

a conductive housing;

a slot in the conductive housing, the slot containing a dielectric material; and a data bus connector disposed within the slot, a resonating element of an antenna disposed within the slot, and a media connector disposed within the slot, the resonating element located between the data bus connector and the media connector, wherein the slot comprises a backwall and sidewalls and an opening in the conductive housing having a same length and height as the backwall, a surrounding surface of the conductive housing defines edges of the opening, wherein the edges of the opening surround the antenna, the first connector and the second connector, and wherein the dielectric material both supports and surrounds the antenna, the first connector and the second connector, and the dielectric material is provided within the slot and is coplanar to the slot.

12. The device of claim 11, wherein the resonating element is coupled to a circuit via a cable, the circuit coupled to the conductive housing.

13. The device of claim 11, wherein a length of the slot is approximately 40-50 mm.

14. The device of claim 11, wherein a height of the slot is approximately 2-5 mm.

15. The device of claim 11, wherein a length of the slot conforms to an electromagnetic wavelength of the resonating element.

* * * * *